US006848704B2

(12) United States Patent
Lucas

(10) Patent No.: US 6,848,704 B2
(45) Date of Patent: Feb. 1, 2005

(54) ADJUSTABLE BASE FOR A SKI BINDING

(75) Inventor: Christian Lucas, Nevers (FR)

(73) Assignee: Look Pixations S.A., Nevers (FR)

( * ) Notice: Subject to any disclaimer, the term of this patent is extended or adjusted under 35 U.S.C. 154(b) by 0 days.

(21) Appl. No.: 10/360,301

(22) Filed: Feb. 7, 2003

(65) Prior Publication Data

US 2003/0151230 A1 Aug. 14, 2003

(30) Foreign Application Priority Data

Feb. 11, 2002 (FR) ..... 02 01614

(51) Int. Cl.[7] ..... A63C 9/00

(52) U.S. Cl. ..... 280/613; 280/618; 280/607; 280/633; 280/617

(58) Field of Search ..... 280/613, 607, 280/623, 631, 632, 633, 624, 625, 626, 629, 634, 635, 617, 616, 618

(56) References Cited

U.S. PATENT DOCUMENTS

| | | | | | |
|---|---|---|---|---|---|
| 3,913,931 | A | * | 10/1975 | Kratky | 280/623 |
| 4,699,397 | A | * | 10/1987 | Freisinger et al. | 280/633 |
| 4,955,633 | A | * | 9/1990 | Stritzl et al. | 280/633 |
| 4,986,562 | A | * | 1/1991 | Freisinger et al. | 280/633 |
| 5,261,688 | A | * | 11/1993 | Rohrmoser | 280/617 |
| 5,344,178 | A | * | 9/1994 | Rohrmoser | 280/617 |
| 5,344,179 | A | * | 9/1994 | Fritschi et al. | 280/618 |
| 5,348,335 | A | * | 9/1994 | Dasarmaux et al. | 280/633 |
| 5,498,017 | A | * | 3/1996 | Rohrmoser | 280/633 |
| 5,732,968 | A | * | 3/1998 | Wladar et al. | 280/633 |
| 5,794,962 | A | * | 8/1998 | Bardin et al. | 280/607 |
| 5,913,532 | A | * | 6/1999 | Viodet et al. | 280/633 |
| 5,975,555 | A | * | 11/1999 | Lehner et al. | 280/618 |
| 6,050,591 | A | * | 4/2000 | Bardin et al. | 280/633 |
| 6,065,895 | A | * | 5/2000 | Lehner et al. | 403/105 |
| 6,092,829 | A | * | 7/2000 | Mercier | 280/617 |
| 6,471,235 | B1 | * | 10/2002 | Luitz et al. | 280/618 |
| 2003/0001363 | A1 | * | 1/2003 | Battistella et al. | 280/618 |

FOREIGN PATENT DOCUMENTS

| | | | | |
|---|---|---|---|---|
| DE | 3150098 | * | 7/1982 | A63C/9/00 |
| DE | 4135899 | | 6/1992 | |
| EP | 0768102 | | 4/1997 | |

OTHER PUBLICATIONS

Preliminary search report in SN FR 0201614.

* cited by examiner

*Primary Examiner*—Christopher P. Ellis
*Assistant Examiner*—J. Allen Shriver
(74) *Attorney, Agent, or Firm*—Bugnion S.A.; John Moetteli

(57) ABSTRACT

Adjustable base for a ski binding, comprising a rail (2) for mounting on a ski, a row of teeth (5) extending parallel to the axis of the rail, a plate (3), for carrying a ski-binding element, mounted slidably on the rail and carrying a toothed latch (11), that can be displaced transversely to the rail, for engaging in the teeth of the row of teeth in order to immobilize the plate on the rail through the action of a knuckle-joint mechanism. The teeth (5) of the row of teeth extend transversely to the rail, occupying approximately half the width of the rail, and the latch (11) includes a number of teeth that is greater than two and advantageously of a length substantially equal to the width of the row of teeth (5), and it is displaceable from one side of the rail to the other.

9 Claims, 3 Drawing Sheets

ADJUSTABLE BASE FOR A SKI BINDING

BACKGROUND OF THE INVENTION

The subject of the present invention is a longitudinally adjustable base for a ski binding, comprising a rail for mounting on a ski, a row of teeth extending parallel to the axis of the rail, a plate, for carrying a ski-binding element, mounted slidably on the rail and carrying a latch that can be displaced transversely to the rail and is equipped with teeth for engaging selectively in the teeth of the row of teeth in order to immobilize the plate on the rail in a selected position, a lever for entrainment of the latch mounted pivotably on the lower face of the plate, and means for holding the latch in a locked position comprising a shoe connected to the lever by a connecting rod forming a knuckle joint with the lever such that in a locked position the shoe is pressed against a support and the lever is held in a locking position.

PRIOR ART

Such a binding base is known from Patent FR 2 739 572 (U.S. Pat. No. 5,794,962), the content of which is cited by reference. In this embodiment, the rail and the row of teeth are formed in drawn sheet, the teeth being formed by cutting and planisbing the sheet in an area between one of the edges and the center of the rail, the plate supporting the binding element covering the edges of the rail. Furthermore, the profile of the teeth of the rail and of the latch lie in planes which extends horizontally, i.e. parallel to the plane of the base, wherein the operative surface of the teeth of the row of teeth (5) and of the latch extend in a plane substantially parallel to the plane of the plate (3). The thickness of the teeth is therefore limited by the thickness of the sheet and the available height inside the base. To offer sufficient resistance to thurst on the plate, the teeth are relatively wide and the latch includes only two teeth. The fineness of the adjustment is therefore limited. The latch is also pushed by a spring in its locking position. An increase in the fineness of the adjustment cannot be achieved without risk of excessively weakening the teeth.

U.S. Pat. No. 5,732,968, the content of which is cited by reference, furthermore discloses an adjustable base that includes a rail having coarse vertical teeth and a sliding plate equipped with a latch, with two teeth, pushed transversely into a locking position by a spring and unlockable by means of a cam lever mounted on the side of the base. Owing to the design of the locking means, the travel of the latch is, in relative terms, very short, as is the length of the teeth measured transversely to the rail. Consequently, it is impossible to reduce the adjustment pitch, i.e., the size of the teeth, without excessively weakening the device.

U.S. Pat. No. 6,065,895, the content of which is cited by reference, discloses a ski-binding base that includes a sliding plate equipped with oblique transverse teeth interacting with a locking piece equipped with corresponding teeth displaceable transversely to the ski in a rectangular window. Admittedly, this structure allows fine adjustment, but only within a small range, i.e. around a rear binding. Such a base is consequently unsuitable for rapid adjustment, such as is required for rental purposes, in particular.

SUMMARY OF THE INVENTION

The object of the invention is to substantially improve the fineness of adjustment without making locking less secure, i.e. without reducing the load capacity of the teeth.

To this end, the base according to the invention is noteworthy in that the profile of the teeth of the row of teeth and of the latch lie in planes perpendicular to the plane of the plate, in that the operative surface of the teeth and of the latch extend in a direction substantially parallel to the plane of the plate, in that, consequently, the teeth of the rail extend transversely to the rail, occupying at least the greater part of half the width of the rail from one edge of the rail, in that the latch includes a number of teeth that is substantially greater than two, and in that the latch is displaceable at least approximately from one side of the rail to the other.

The length of the latch measured transversely to the rail is preferably substantially equal to the width of the row of teeth.

When the latch is engaged in the teeth of the row of teeth, the thrust of the teeth of the latch on the teeth of the row of teeth, resulting from the thrust of the boot on the binding element carried by the plate, is distributed over several teeth, preferably over a length of teeth that is substantially equal to half the width of the rail, which has the effect of reducing specific pressure on the teeth.

To change from the locked position to the unlocked position, it is necessary for it to be possible for the latch to be displaced by a distance substantially equal to the width of the rail. This has been made possible by dispensing with the spring found in prior-art devices.

It is therefore possible to obtain an adjustment pitch of less than 3 millimeters, for example 2.5 mm.

The row of teeth is advantageously formed on a plate fixed to the rail or displaceable relative to the rail.

The latch and the plate carrying the row of teeth are advantageously produced in a molded synthetic material, such as a glass-fiber-reinforced polyamide.

The base may be designed to support a ski-binding element, for example a front binding element, or to form part of an assembly supporting the front and rear binding elements with the possibility of a symmetrical displacement, as described in U.S. Pat. No. 5,261,688, the content of which is cited by reference and U.S. Pat. No. 6,092,829, the content of which is cited by reference, or in U.S. Pat. No. 5,344,178, the content of which is cited by reference.

BRIEF DESCRIPTION OF THE DRAWINGS

The appended drawing shows, by way of example, one embodiment of the invention.

DESCRIPTION OF THE PREFERRED EMBODIMENT

Figure 1:
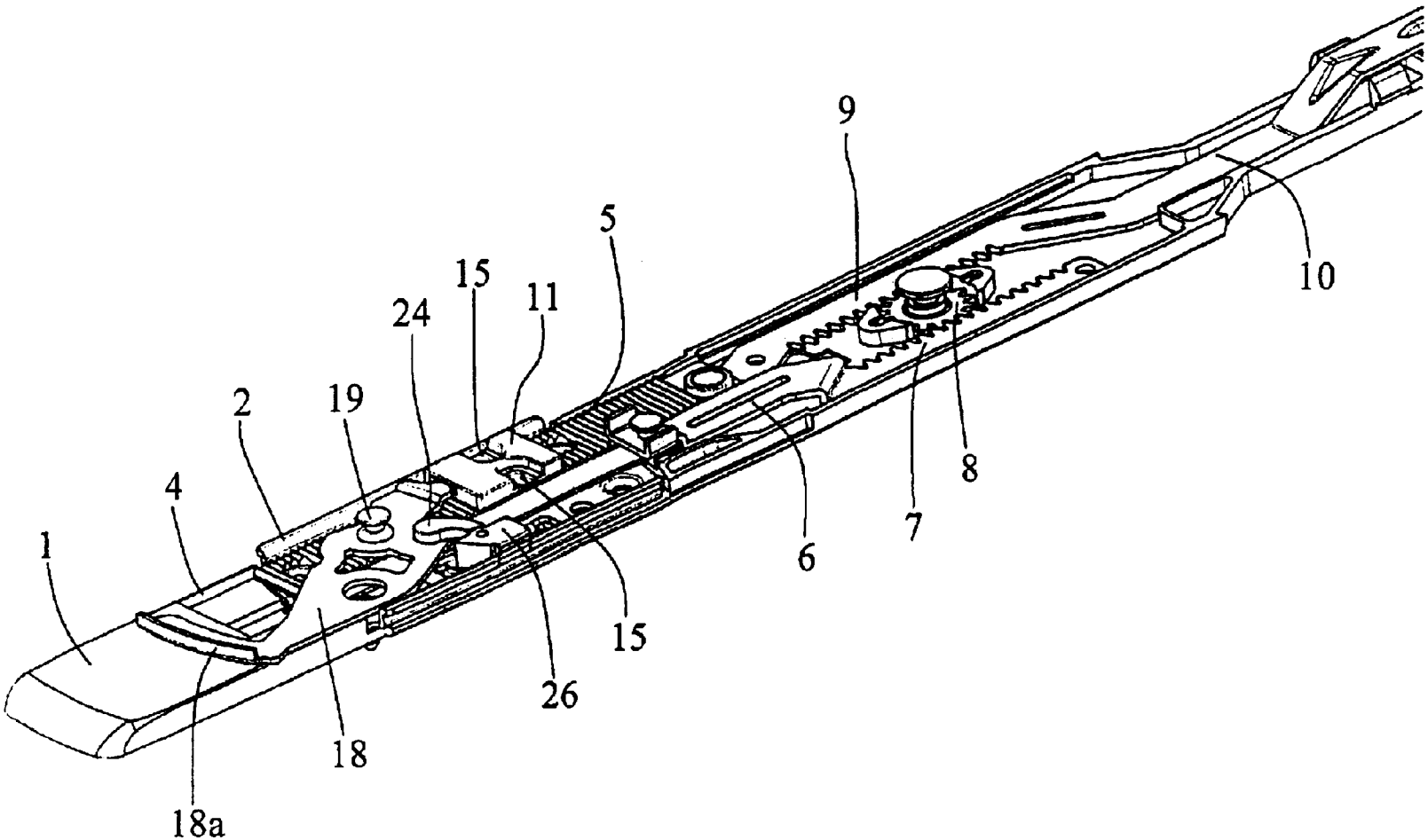
FIG. 1 is a perspective view of a ski-binding base with symmetrical adjustment, from which the plate for supporting the rear binding element (heelpiece) has been removed in order to reveal the fine-adjustment means and the locking mechanism.
Figure 2:
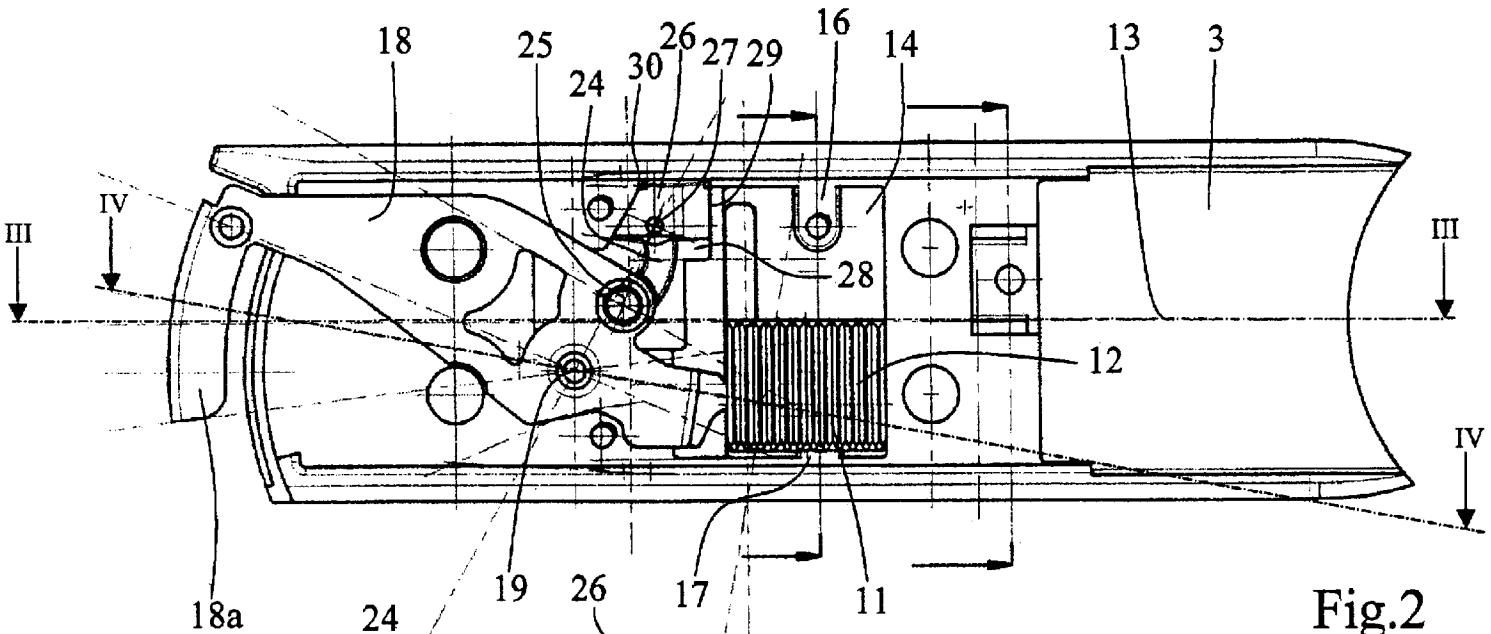
FIG. 2 is a bottom view of the plate removed in FIG. 1.
Figure 5:
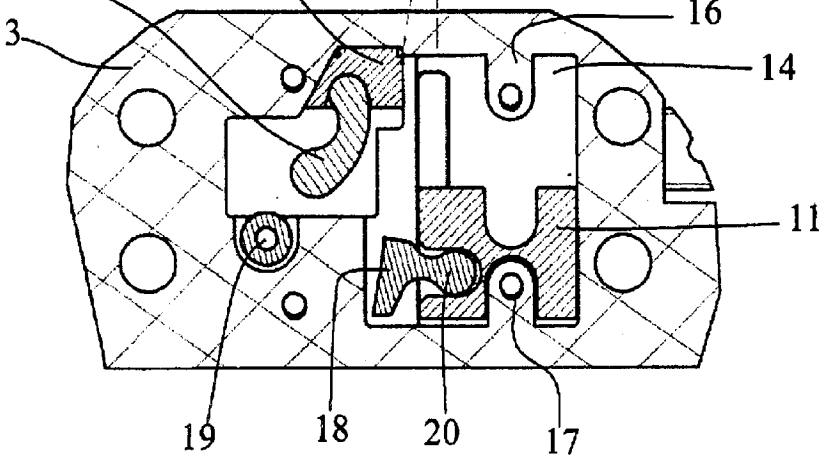
FIG. 5 is a partial view, in the form of a section along V—V in FIG. 3.
Figure 3:
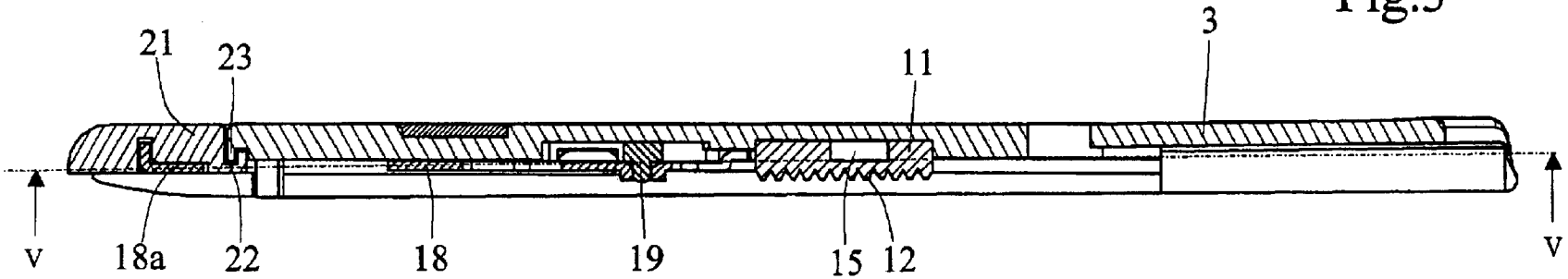
FIG. 3 is a sectional view along III—III in FIG. 2.
Figure 4:
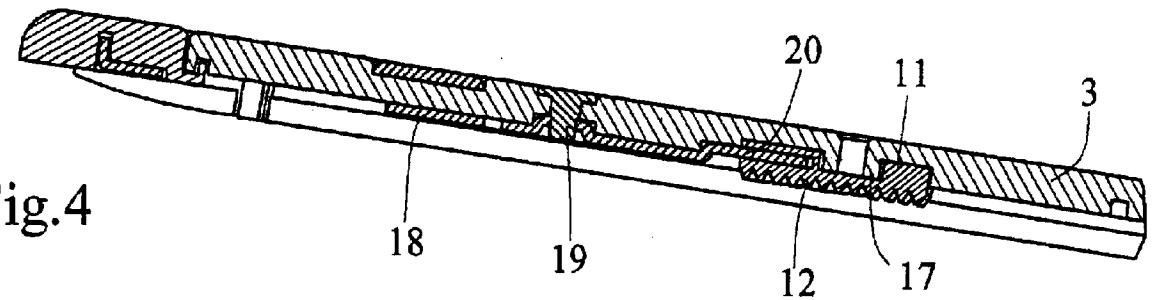
FIG. 4 is a sectional view along IV—IV in FIG. 2.

FIG. 1 shows partially a base piece 1 for fastening to a ski. On this base piece 1 is fastened a metal rail 2 in the form of a slide with raised edges bent outward in a known manner. The plate 3 shown in FIGS. 2 to 5 is mounted slidably on the rail 2.

Inside the rail 2, guided by an edge 4 of the base piece 1, is mounted a toothed plate 5 with a width substantially equal to half the inner space of the rail 2 and equipped with teeth transverse to the axis of the rail 2. This toothed plate is made from molded synthetic material, for example glass-fiber-reinforced polyamide. The toothed plate 5 is integral with a first rack 9 connected by an extension 10 to the support (not shown) of the rear binding element. The rack 9 meshes, in a known manner, with a central pinion 8 with a vertical pin meshing, on the opposite side, with a second rack 7 equipped with an arm 6 connected to the plate 3 supporting the front binding element. The assembly constitutes a base with symmetrical adjustment of the spacing of the front and rear binding elements. This application is given solely by way of example.

On the lower face of the plate 3 is mounted a latch 11 consisting of a rectangular small plate equipped with teeth 12 that are similar and that correspond to the teeth of the plate 5 and extend, like the former, transversely to the rail 2, i.e. to the longitudinal axis 13 of the plate 3. The latch 11 is guided in a hollow 14 of the plate 3, and, on its upper face, it has two recesses 15 for two areas 16 and 17 of initial thickness of the plate 3 for receiving screws for fastening the ski-binding element. The latch 11 includes 12 teeth in the example shown, and its length, measured in the direction transverse to the plate 3, is substantially equal to half the inner width of the rail 2. The latch 11 may be displaced from one end of the hollow 14 to the other. In the example shown, the pitch of the teeth is equal to 2.5 mm.

The displacements of the latch 11 are achieved by means of a lever 18 mounted rotatably on a pivot 19. This lever 18 is equipped with a rounded end 20 engaged in the latch 11 for the entrainment of this latch. The other arm of the lever 18 has a bent part 18*a* embedded in a piece 21 made from synthetic material, forming an operating handle for the lever 18. This handle 21 itself has a groove 22 in the form of an arc of a circle interacting with a part 23 of matching shape in the plate 3 for guiding thereof.

The lever 18 is furthermore equipped with a connecting rod 24 that is articulated on the lever 18 about a pin 25 and equipped with a shoe 26 that is articulated on the connecting rod about a pin 27 and housed in a housing 28 in the plate 3, in which it is guided by a side 29 perpendicular to the axis 13 and a side 30 that is oblique relative to said axis.

The base is shown in a locked position. As may be seen in FIG. 1, the latch 11 is totally on the toothed plate 5, i.e. entirely located in half of the width of the rail 2, with its teeth totally engaged in the teeth of the plate 5. In this position, the end 20 of the lever exerts a thrust on the latch so as to press this latch against the end of the hollow 14, while the shoe 26 is pressed, in the opposite direction, against the sides of its housing 28. The knuckle joint formed by the lever 18 and the connecting rod 24 is of such a size that a pressure is maintained, on the one hand, on the latch and, on the other hand, on the shoe 26, the pin 25 being located to the right of the straight line connecting the pins 19 and 27, i.e. on the same side as the latch 11.

Unlocking is achieved by means of the handle 21. The latch 11 is displaced so as to be located entirely in the other half of the inner width of the rail 2.

In the case of a base without symmetrical adjustment, the toothed plate 5 would be fastened to the rail.

The rail and the teeth could be made as a single piece.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed:

1. A longitudinally adjustable base for a ski binding, comprising (a) a rail (2) for mounting on a ski, (b) a row of teeth (5) extending parallel to the axis of the rail, (c) a plate (3), for carrying a ski-binding element, mounted slidably on the rail and carrying a latch (11) that (i) can be displaced transversely to the rail and (ii) is equipped with teeth (12) for engaging selectively in the teeth of the row of teeth in order to immobilize the plate on the rail in a selected position, (d) a lever (18) for actuating the latch mounted on the lower face of the plate (3), and (e) means for holding the latch in a locked position comprising a shoe (26) connected to the lever (18) by a connecting rod (24) forming a knuckle joint with the lever such that in a locked position the shoe is pressed against a support and the lever is held in a locking position, wherein the operative surface of the teeth of the row of teeth (5) and of the latch extend in a plane substantially parallel to the plane of the plate (3), wherein the teeth (5) of the row of teeth extend transversely to the rail, wherein the latch (11) includes at least two of said teeth (12), and wherein the latch (11) is transversely displaceable with respect to the rail.

2. The base as claimed in claim 1, wherein the length of the latch, measured transversely to the rail, is substantially equal to the width of the row of teeth (5).

3. The base as claimed in claim 1, characterized in that the pitch of the teeth is between 2 and 3 mm.

4. The base as claimed in claim 1, wherein the row of teeth (5) is integral with the rail.

5. The base as claimed in claim 1, wherein the row of teeth (5) is displaceable relative to the rail.

6. The base as claimed in claim 5, wherein the row of teeth (5) is integral with a rack that can be entrained by a pinion.

7. The base as claimed in claim 1, wherein the row of teeth (5) is formed on a plate integral with the rail or with a rack that can be entrained by a pinion.

8. The base as claimed in claim 7, wherein said plate (3) and the latch (11) are made from a molded synthetic material.

9. A longitudinally adjustable base for a ski binding mountable on a ski, the ski having a top surface defined by a ski width dimension and a ski length dimension extending along a longitudinal axis of the ski, the base comprising:

(a) a rail (2) for mounting on the ski, the rail slidable along the base and defined by a rail width dimension, a rail thickness dimension, and a longitudinal length, in which the rail width dimension is much greater than the rail thickness dimension, the rail width dimension extending parallel to the ski width dimension and the rail thickness dimension extending perpendicular to the top surface of the ski, when mounted on the ski, (b) a plate (3) disposed within the rail, the plate comprising a row of small teeth (5) having an operative surface extending in a direction substantially parallel to the plane of the plate and disposed along the longitudinal length, the teeth having a pitch, the pitch being much smaller than the width of the teeth, and (c) a latch (11) having small teeth having an operative surface extending in a direction substantially parallel to the plane of the plate, which selectively mate with the small teeth (5) of the plate, and (d) an actuation mechanism capable of selectively moving the latch (11) in and out of engagement with the plate, so as to block and respectively unblock relative movement between the plate and the latch.

* * * * *